US005566826A

United States Patent [19]

Evans

[11] Patent Number: 5,566,826

[45] Date of Patent: Oct. 22, 1996

[54] DISPOSABLE ADHESIVE NECKTIE FASTENER

[76] Inventor: Robert L. Evans, 161 Lakeview Dr., Cordele, Ga. 31015

[21] Appl. No.: 391,659

[22] Filed: Feb. 21, 1995

[51] Int. Cl.[6] ..... B65D 85/02

[52] U.S. Cl. ..... 206/338; 206/344; 206/345; 206/409

[58] Field of Search ..... 206/338, 343, 206/344, 345, 348, 389, 390, 409, 447, 460; 2/177, 156

[56] References Cited

U.S. PATENT DOCUMENTS

| | | | |
|---|---|---|---|
| 2,276,296 | 3/1942 | Flood | 206/390 X |
| 2,417,497 | 3/1947 | Hulslander, Sr. | 206/390 |
| 2,588,576 | 3/1952 | Roop et al. . | |
| 3,042,983 | 7/1962 | Riedler . | |
| 3,190,443 | 6/1965 | Kingsley | 206/389 |
| 3,283,888 | 11/1966 | Scott | 206/447 |
| 3,411,978 | 11/1968 | Frohbach et al. | 206/820 X |
| 3,530,494 | 9/1970 | Baratta | 206/820 X |
| 3,869,333 | 3/1975 | McMaster | 206/820 X |
| 4,055,249 | 10/1977 | Kojima | 206/390 X |
| 4,060,168 | 11/1977 | Romangnoli | 206/216 |
| 4,807,753 | 2/1989 | Goldstein | 206/390 |
| 4,972,523 | 11/1990 | Begg . | |
| 5,064,060 | 11/1991 | Connell et al. | 206/338 X |

*Primary Examiner*—Paul T. Sewell
*Assistant Examiner*—Tara Lester
*Attorney, Agent, or Firm*—Jones & Askew

[57] ABSTRACT

A disposable one-piece necktie fastener comprising a flat paper wafer bearing adhesive on both sides that serves to attach the two ends of a necktie to each other when placed therebetween. A necktie fastener may bear indicia such as an advertisement. The necktie fastener is preferably round, or substantially round with a handle portion protruding from the periphery, such handle portion not bearing adhesive. A streamer of necktie fasteners comprises a plurality of fasteners disposed between two ribbons of wax-coated paper. The ribbons include a perforated seam between adjacent necktie fasteners. A hollow container for holding and dispensing a streamer of necktie fasteners including an opening through which the streamer may pass from inside to outside the container.

2 Claims, 2 Drawing Sheets

Fig. 6
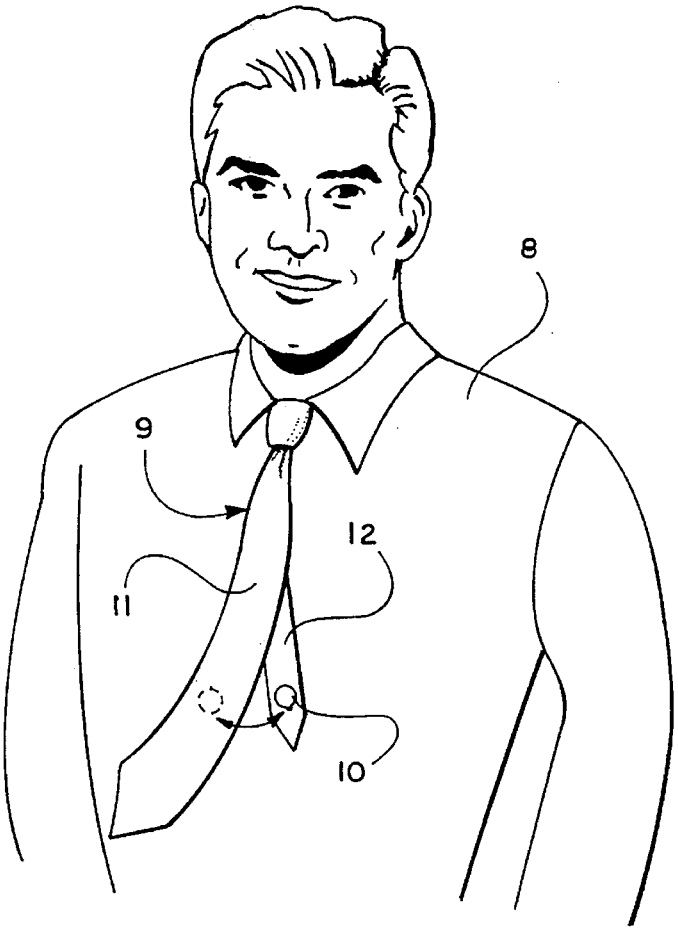
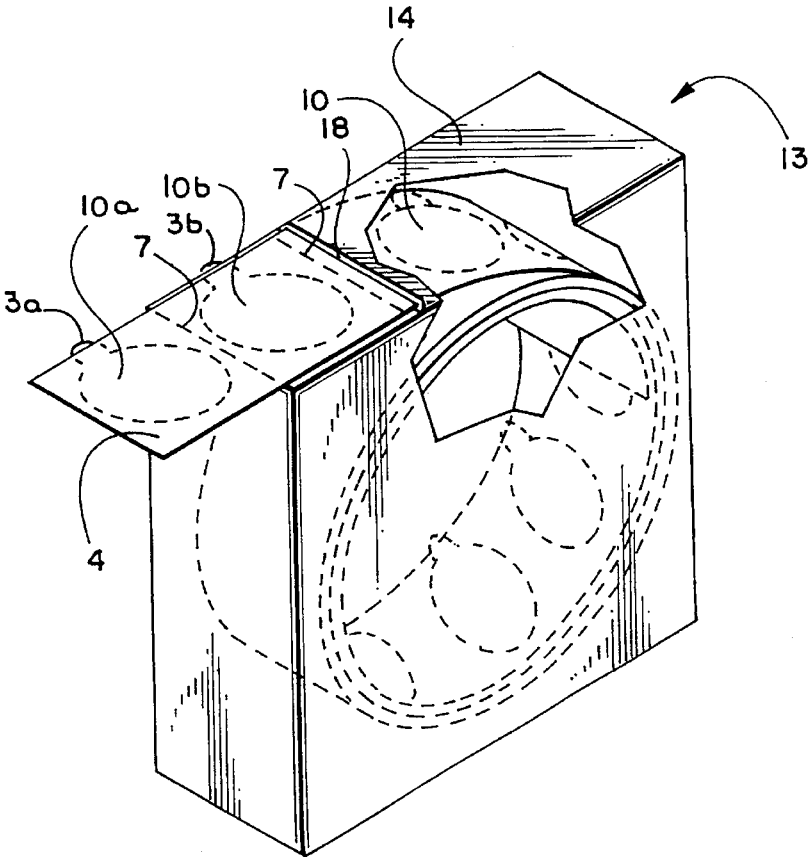
Fig. 7

DISPOSABLE ADHESIVE NECKTIE FASTENER

TECHNICAL FIELD

The present invention generally pertains to necktie fasteners and more particularly pertains to a disposable one-piece necktie fastener comprising a flat wafer with adhesive on both sides. Additionally, the present invention pertains to a streamer of such necktie fasteners removably affixed to at least one ribbon, and to a container for holding and dispensing such a streamer of necktie fasteners.

BACKGROUND ART

Numerous necktie fasteners are available including various pins, clasps, fasteners and holders. Many of these fasteners operate by piercing, compressing, or hanging about a necktie and therefore can damage a necktie in the course of normal use. Other necktie fasteners require that a strip of fabric or hook-and-loop material be permanently or semi-permanently attached to a necktie. Such attachments can accumulate lint and/or catch on objects. Such fasteners are particularly undesirable for wearers of expensive neckties.

DISCUSSION OF PRIOR ART

Typically, the ends of a necktie are held together by a label that is usually attached at opposite ends to the back of the display end of the necktie. The label serves as a holder through which the tail end is normally placed. However, the label may become unattached through wear or accident, so that it cannot serve as a holder for the tail end of the necktie. Alternatively, the necktie may not be long enough to allow the tail end to be placed through the holder formed by the label. Therefore, a need exists for a convenient and inexpensive article for fastening together the two ends of a necktie when the label cannot be used as a holder.

Roop et at., U.S. Pat. No. 2,588,576, shows a necktie holder that works in conjunction with a shirt button. The fastener is attached to the back of the display end of a necktie by an adhesive that is softened and cured by applying a hot iron to effect the union. The attachment is therefore intended to be permanent. Removing the fastener would likely damage the necktie, and leave a residue on the back side of the display end of the necktie. Moreover, the fastener is large and bulky. Therefore, after Roop et al. there remains a need for a smaller, less expensive, disposable necktie fastener that does not damage a necktie during the normal course of use.

Riedler, U.S. Pat. No. 3,042,983, also shows a necktie holder that works in conjunction with a shirt button. The fastener extends around the display end of the necktie and is therefore visible in the normal course of use. Many wearers of neckties, particularly those donning expensive neckties, do not wish to wear a visible necktie holder. Therefore, after Riedler there remains a need for a necktie holder that is not visible in the normal course of use.

Begg, U.S. Pat. No. 4,972,523, also shows a necktie holder that works in conjunction with a shin button. The fastener has two parts comprising a hook-and-loop type fastener. A first part is affixed to the back of the display end of a necktie, and a second part is attached to a shirt button. Begg does not teach a means for attaching the first part to the necktie in a manner that does not damage the necktie. Moreover, a two-part hook-and-loop type fastener is more expensive than a paper fastener. Thus, after Begg there remains a need for a less expensive, disposable necktie fastener that does not damage a necktie in the normal course of use.

Clothing designers, fragrance manufacturers and other retailers have a need for inexpensive advertising devices. Impulse items offered for sale in retail establishments can, and often do, meet this need. Such impulse items may be displayed near a cash register where purchasers waiting in line can easily see and elect to purchase such items.

It is therefore an object of the present invention to provide a necktie fastener that does not damage a necktie in the course of normal use.

It is a further objective of the present invention to provide an inexpensive, disposable one piece necktie fastener.

It is a further objective of the present invention to provide a necktie fastener that has a handle portion to allow the fastener to be easily grasped.

It is a further objective of the present invention to provide a necktie fastener that may bear indicia.

It is a further objective of the present invention to provide a streamer of necktie fasteners wherein the fasteners are removably attached to at least one ribbon.

It is a further objective of the present invention to provide an inexpensive and convenient dispenser for such necktie fasteners.

SUMMARY OF THE INVENTION

The above-mentioned objectives of the present invention are accomplished in a necktie fastener that is a flat wafer beating adhesive on both sides. The adhesive on the wafer is strong enough to hold the two ends of a necktie together during normal wear, but it is not so strong that it damages the necktie when removed. The adhesive has a greater affinity for the wafer than for a necktie so that little if any adhesive is transferred from the wafer to the necktie. Therefore, a necktie fastener according to the present invention will not damage the necktie in the normal course of use.

According to another aspect of the invention, a plurality of disposable necktie fasteners are packaged into a streamer by attaching them to a perforated ribbon, or alternatively by placing them between two perforated ribbons. The perforated ribbon has a lower affinity for the adhesive than does the wafer body of a necktie fastener so that the adhesive remains substantially affixed to the necktie fastener when a necktie fastener is attached to, and subsequently removed from, a ribbon. A ribbon has a perforated seam between adjacent necktie fasteners along which one necktie fastener at a time in conjunction with a length of ribbon is easily torn from the streamer. The streamer is housed in a container from which one end of the streamer extends.

According to another aspect of the invention, the upper ribbon may be omitted such that streamer comprises only one ribbon. Rather, a necktie fastener may be carried on a single ribbon wound into a roll so that each tie tack is positioned between two adjacent layers of the roll. One side of the ribbon may have a slightly higher affinity for the adhesive than the other to ensure that the tie tacks will adhere to a predetermined side of the ribbon when the roll is unwound. The roll is housed in the container, and is unwound as the tie tacks are dispensed. One skilled in the art will appreciate that in this manner, one ribbon protects the tie tacks until they are dispensed.

A user extracts a necktie fastener from the container by pulling on the exposed streamer, or by placing a thumb or finger against the exposed portion of the streamer and thrusting, until a length of streamer comprising at least one full necktie fastener extends out of the container. Then, one necktie fastener attached to a length of ribbon, or alternatively disposed between two lengths of ribbon (i.e., an upper and lower length of ribbon between adjacent perforated seems), may be torn free from the streamer. The wafer is then removed and placed between the ends of a necktie. With the above configuration, the necktie fasteners will be convenient, inexpensive and disposable.

A retail clothing establishment or department store that sell neckties, or a vendor selling product therein, would find the present invention attractive for advertising purposes. For example, the necktie fasteners themselves, the ribbons, and the containers would each provide an advertising medium for printed indicia. In addition, a necktie fastener would be a convenient vehicle for carrying a fragrance as a means for a fragrance manufacturer to advertise its product. A necktie fastener according to the present invention will thus provide a cost effective advertising medium. The ribbons and dispenser also will provide cost effective advertising media.

BRIEF DESCRIPTION OF THE DRAWINGS

FIG. 6 shows a preferred embodiment comprising a necktie fastener disposed on a necktie.

FIG. 7 shows a perspective view of a preferred embodiment of a dispenser, partially cut away, containing a streamer of necktie fasteners, according to another aspect of the invention.

DETAILED DESCRIPTION OF THE PREFERRED EMBODIMENTS

Figure 1:
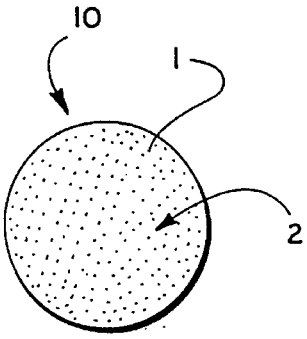
FIG. 1 shows a top view of a preferred embodiment of the necktie fastener.

FIG. 1 shows necktie fastener 10 constructed in accordance with the preferred embodiment of the present invention. Wafer I is round and flat and bears adhesive 2 on its surface. The fastener 10 comprises a wafer 1 that is preferably made of paper or other thin disposable sheet-like material, and is approximately one inch in diameter. Adhesive 2 is preferably a light duty industrial adhesive such as that commonly found in cellophane and similar types of adhesive tapes. The surface of wafer 1 may bear indicia such as an advertisement or a fragrance. The above dimensions may be varied somewhat without unduly affecting the performance of the present invention.

Figure 2:
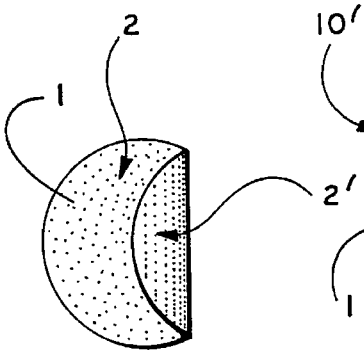
FIG. 2 shows a sectional view of a preferred embodiment of the necktie fastener.

FIG. 2 shows that wafer 1 preferably has adhesive on both sides, 2 and 2'. Having adhesive on both sides allows wafer 1 to function as a necktie fastener when placed between the ends of a necktie. The preferred adhesive on the wafer is strong enough to hold the two ends of a necktie together during normal wear, but it is not so strong that it damages the necktie when removed. The adhesive has a greater affinity for the wafer than for a necktie so that little if any adhesive is transferred from the wafer to the necktie.

Figure 3:
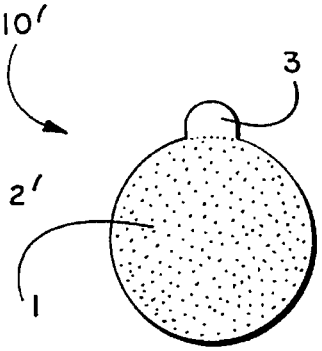
FIG. 3 shows an alternative configuration of a preferred embodiment of the necktie fastener.

According to another aspect of the present invention, FIG. 3 shows an alternative configuration, necktie fastener 10', wherein wafer 1 includes a handle portion 3 extending from the periphery of the wafer which does not bear adhesive. The handle portion 3 is approximately one-fourth of an inch long. This dimension may be varied somewhat without unduly affecting to performance of the present invention. Handle portion 3 is an extension of, and is made of the same material as, wafer 1, but does not bear adhesive on either side.

Figure 4:
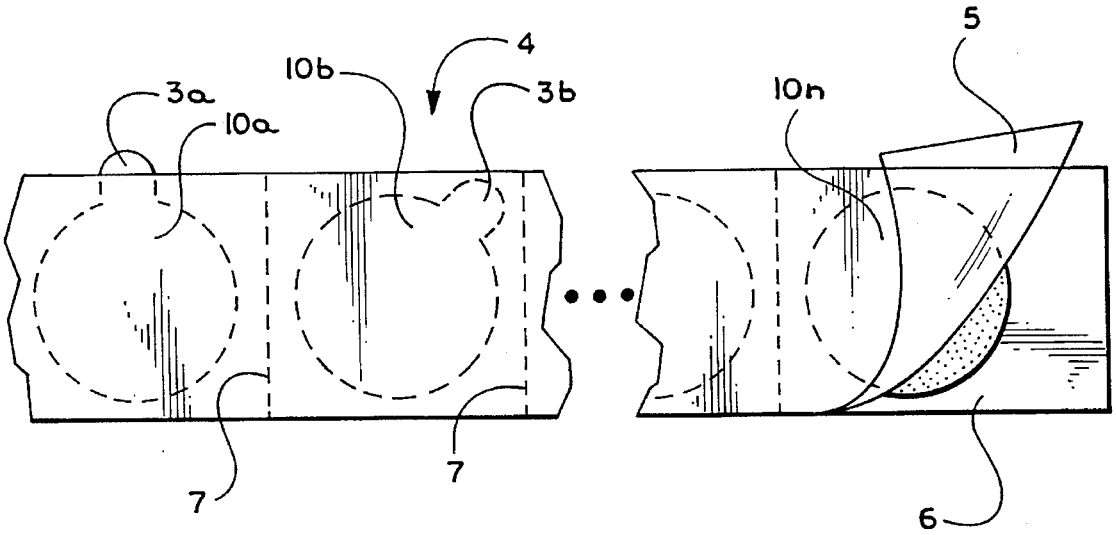
FIG. 4 shows a top view of a preferred embodiment including a streamer of necktie fasteners.

FIG. 4 shows a streamer 4 comprising a plurality of necktie fasteners **10*a* through 10*n* removably disposed between an upper ribbon 5 and a lower ribbon 6. The ribbons are preferably made of wax-coated paper, and are approximately one and one-eight of an inch wide, although this dimension may be varied somewhat without unduly affecting the performance of the present invention. The ribbons have a lower affinity for the adhesive than does wafer 1, so that the adhesive remains substantially affixed to the necktie fastener when a fastener is removed from a ribbon. Each ribbon has a perforated seam 7** between adjacent necktie fasteners along which one necktie fastener at a time in conjunction with an upper and lower length of ribbon is easily torn from the streamer. The ribbons protect a necktie fastener until it is ready for use.

FIG. 4 shows several alternative embodiments for the disposition of necktie fasteners **10*a* through 10*n* between ribbon 5 and 6. Necktie fastener 10*n* is shown to be substantially round. Alternatively, fastener 10*a* is shown to be substantially round, with the handle portion 3a extending outwardly beyond the lateral edge 12 of streamer 4. Fastener 10*b* is shown to be substantially round with a handle portion 3*b* protruding from the periphery, with the handle portion angularly rotated relative to the lateral edge 12 of streamer 4** such that the handle portion is protected by the streamer.

Figure 5:
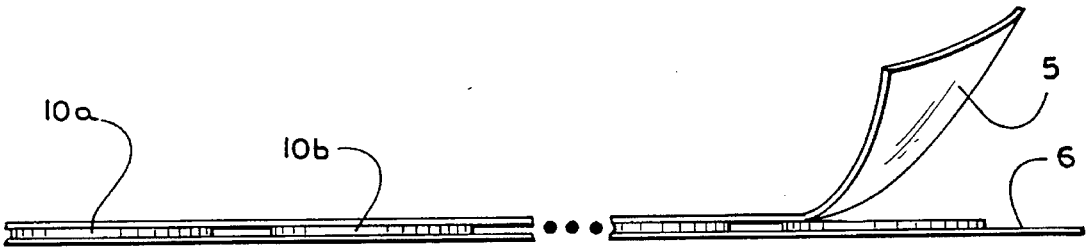
FIG. 5 shows a side view of the streamer of necktie fasteners shown in FIG. 4.

FIG. 5 shows a side view of the streamer 4, with the upper ribbon 5 partially unattached from the lower ribbon 6 and fasteners. As shown on the left hand portion of FIG. 5, a necktie fastener 10 may be carried between an upper ribbon 5 and a lower ribbon 6.

According to another aspect of the invention, upper ribbon 5 may be omitted such that streamer 4 comprises only one ribbon. As shown on the right hand portion of FIG. 5, a necktie fastener 10 may be carried on a single ribbon 6. A single ribbon streamer is wound into a roll so that each tie tack is positioned between two adjacent layers of the roll. One side of the ribbon may have a slightly higher affinity for the adhesive than the other to ensure that the tie tacks will adhere to a predetermined side of the ribbon when the roll is unwound. The roll is housed in the container, and is unwound as the tie tacks are dispensed. One skilled in the art will appreciate that in this manner, one ribbon protects the tie tacks until they are dispensed.

FIG. 6 shows the preferred mode of using the present invention. A shirt 8 has a necktie 9 worn thereon in the usual manner. Necktie 9 has a display end 11 and a tail end 12. Wafer 10 is placed on the outward face of the tail end and on the inward face of the display end of the necktie. Wafer 10 thereby functions as a necktie fastener keeping the display end of the necktie removably attached to the tail end.

FIG. 7 shows a container 13, shown partially cut away to reveal the interior, for holding and dispensing streamer 4 comprising at least one necktie fastener 10. A user extracts a necktie fastener from the container by pulling on the exposed streamer 4 as it extends from a slot 18 in the container 1 3, or by placing a thumb or finger against the exposed portion of the streamer and thrusting, until a length of streamer comprising at least one full necktie fastener extends out of the container. Then, one necktie fastener disposed between two tabs (i.e., an upper and lower length of ribbon between adjacent perforated seams) may be torn free from the streamer. The tabs are then removed from the wafer, and the wafer is placed between the ends of a necktie.

A retail clothing establishment or department store that sell neckties, or a vendor selling product therein, will find the present invention attractive for advertising purposes. For example, the necktie fasteners themselves, the ribbons, and the container each provide an advertising medium for printed indicia. In addition, a necktie fastener is a convenient vehicle for carrying a fragrance. The ribbons substantially prevent a fragrance that may be carried on the necktie fastener from escaping from until the necktie fastener is removed from between the ribbons.

The dispenser is a disposable box preferably made of paper or cardboard. Each dispenser contains a streamer comprising a plurality of necktie fasteners disposed between wax-coated paper ribbons.

Alternatively, the dispenser may be a reusable vessel from which successive streamers of necktie fasteners may be dispensed, such as a decorative plastic or ceramic container. Refill rolls of necktie fasteners can be placed into and dispensed from the reusable container.

While certain representative embodiments and details have been shown for the purpose of illustrating the invention, it will be apparent to those skilled in this art that various changes and modifications may be made to the invention without departing from the spirit or scope of the invention. In particular, it is anticipated that the present invention will be used as a fastener for articles other than a necktie, and for the purpose of displaying the indicia or fragrance carried thereon without also being used as a fastener. The invention therefore is only limited by the scope of the appended claims.

What is claimed is:

1. An article of manufacture, comprising:

a plurality of necktie fasteners, each necktie fastener for removably attaching a display end of a necktie to a tail end of said necktie, each necktie fastener comprising a flat substantially circular wafer having a first side and a second side bearing adhesive on said first and second sides, said adhesive having a greater affinity for said wafer than for said necktie such that said adhesive will remain substantially affixed to said wafer when attached to and subsequently removed from said necktie;

said necktie fasteners removably attached to at least one perforated ribbon having an edge, said adhesive having a greater affinity for said wafer than for said ribbon such that said adhesive will remain substantially affixed to said wafer when attached to and subsequently removed from said ribbon;

each necktie fastener having an integral handle portion extending from the periphery of said wafer;

each necktie fastener positioned on said ribbon so that said handle portion extends laterally beyond the edge of said ribbon.

2. The article of manufacture of claim 1, wherein said ribbon with said necktie fasteners attached thereto is removably carried within a hollow container.

* * * * *